US005289627A

United States Patent [19]

Cerny et al.

[11] Patent Number: 5,289,627

[45] Date of Patent: Mar. 1, 1994

[54] FUEL INJECTOR ASSEMBLY AND CALIBRATION METHOD

[75] Inventors: Mark S. Cerny, Sterling Hgts; James F. Prestel, Rochester, both of Mich.

[73] Assignee: Chrysler Corporation, Highland Park, Mich.

[21] Appl. No.: 993,206

[22] Filed: Dec. 18, 1992

[51] Int. Cl.[5] ..... H01F 41/02

[52] U.S. Cl. ..... 29/602.1; 239/585.5; 251/129.21

[58] Field of Search ..... 29/602.1, 606; 251/129.21; 239/585.5

[56] References Cited

U.S. PATENT DOCUMENTS 4,231,525 11/1980 Palma .
4,245,789 1/1981 Gray .
4,247,052 1/1981 Gray .
4,331,317 5/1982 Kamai .
4,342,427 8/1982 Gray .
4,520,962 6/1985 Momono .
5,189,782 3/1993 Hickey ..... 29/602.1

*Primary Examiner*—Carl E. Hall
*Attorney, Agent, or Firm*—Kenneth H. MacLean

[57] ABSTRACT

An improved fuel injector for an internal combustion engine generating very fine atomization of fuel even at initiation of the valve opening event and including a cylindrical valve element terminating in a semi-spherical end portion which engages a valve seat to close the injector, fuel quantity being controlled by cycling the valve alternately between opened and closed positions at a desired variable rate. Improved fuel atomization is generated by providing an annular space upstream of the valve seat, this annular space being so narrow and short as not to form a significant volume of motionless fuel when the valve is closed which would generate large fuel particles upon initiation of valve opening.

5 Claims, 3 Drawing Sheets

FUEL INJECTOR ASSEMBLY AND CALIBRATION METHOD

BACKGROUND OF THE INVENTION

1. Field of the Invention

This application concerns an electromagnetically actuated type of fuel injector and its method of assembly and calibration. The subject injector design includes a generally tubular housing with open ends permitting end insertion of an actuator subassembly into one end and a valving subassembly into the opposite end. The valving subassembly is axially positioned relative to the housing to define a predetermined maximum opening followed by attachment of the subassembly to the housing. This calibration method accurately establishes the flow rate for the fuel injector.

2. Description of Related Art

It is important in the design of fuel injectors to provide a device which is both easy to assemble and then calibrate resulting in consistent operational characteristics, such as flow rates.

By necessity, a modern electromagnetically actuated fuel injector has a many parts. Assembling each part one after another is very undesirable. The resultant complex structure leads to inaccuracies caused by stacking of normal tolerances. As a result, the fuel injector is difficult to accurately calibrate.

An example of a fuel injector design that is thought to be relatively difficult to assemble and to calibrate includes the devices disclosed in U.S. Pat. Nos. 4,245,789; 4,247,052; 4,231,525; and 4,342,427. One end of the fuel injector housing receives: a bobbin assembly; a pole piece assembly; and a spring calibration and armature guide assembly. A second end of the injector housing receives: an armature; a valve seat assembly; and a threaded calibration member. To calibrate the injector, the armature position is established by one adjustment while the location of the valve seat relative to the valve is established by another adjustment.

The fuel injector disclosed in U.S. Pat. No. 4,331,317 utilizes a housing's interior spacer to establish a desired axial positioning of both an armature to core and a valve to valve seat calibration. In addition, a pressed-in member establishes the position of a spring support. The fuel injectors disclosed in U.S. Pat. Nos. 4,331,317 and in 4,520,962 use a spacer-stopper for calibration. Also, a spring position is established by a separate adjustment.

SUMMARY OF THE INVENTION

The subject fuel injector is a pulse width modulated type injector. At any particular engine operating condition, an associated control circuitry for the injector opens the valve for a predetermined period of time needed to inject a desired quantity of fuel into the engine's combustion chamber.

The injector design lends itself to simple assembly and easy calibration. Specifically, the generally tubular injector housing has opposite open ends. An electromagnetic actuator subassembly is inserted into one end of the housing and seats against a shoulder. This actuator subassembly is attached or fixed to the housing by turning or rolling an upper edge portion of the housing over an exterior end surface of the subassembly. Next, valve, valve seat, and armature subassembly is inserted into the opposite end of the housing. It is spaced a predetermined distance with respect to a stationary portion of the actuator assembly to establish a desired maximum valve opening for the injector. Then, the valved subassembly is permanently attached to the housing. Resultantly, a sequential assembly operation followed by a calibration operation readies the injector for use.

Further advantages of the subject fuel injector design and method of assembly and calibration will be more readily apparent from a reading of the following detailed description of a preferred embodiment which is illustrated in the accompanying drawings as described below.

IN THE DRAWINGS

FIG. 1 is a sectioned elevational view of the subject fuel injector showing the initial first assembly step; and FIG. 2 is a sectioned elevational view of the subject fuel injector showing the second and third assembly steps; and FIG. 3 is a sectioned elevational view of the subject fuel injector showing the simultaneous fourth assembly and calibration step; and FIG. 4 is a sectioned elevational view of the subject fuel injector showing the installation of the assembled and calibrated fuel injector to an associated engine; and FIG. 5 is a sectioned elevational view of the subject fuel injector showing the assembled and calibrated fuel injector as installed in an associated engine.

DETAILED DESCRIPTION OF A PREFERRED EMBODIMENT

Figure 1:
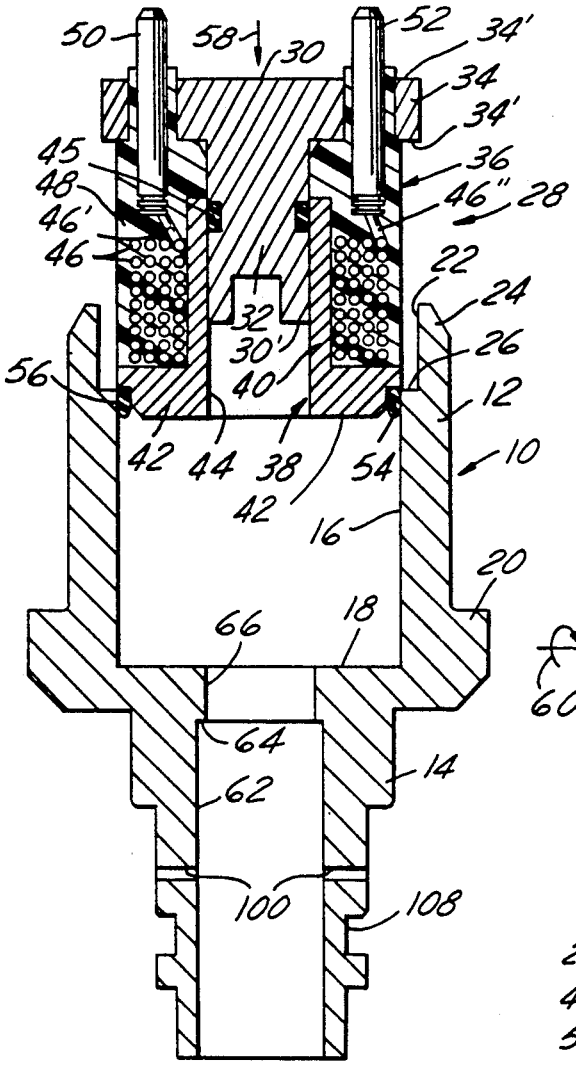

In FIG. 1, a tubular housing 10 of the subject fuel injector is illustrated. Housing 10 includes an upper portion 12 and a lower portion 14. Upper portion 12 has a main bore 16 extending therein terminated by an interior shoulder portion 18 near the midportion of housing 10. A radially outwardly extending exterior portion 20 encircles the midportion of the housing 10. Further, the upper edge or end of housing 10 has a shallow bore or cut 22 which is larger than main bore 16. Resultantly, a thinned cylindrical edge 24 projects axially upward from the main body of the housing 10. A shoulder portion 26 is defined between bores 16, 22.

An electromagnetic actuator subassembly 28 is shown in FIG. 1 positioned just prior to its insertive attachment to housing 10. The subassembly 28 includes an upper pole piece 30 which has a central portion 32 and a radially outwardly extending top end portion 34. A coil and terminal subassembly 36 of the actuator extends about central portion 32 of the pole piece and under portion 34. The subassembly 28 includes a tubular bobbin base member 38 molded of elastomeric material. The bobbin member 38 has a central tubular portion 40 and a radially outwardly extending lower end edge portion 42. The bobbin member 38 defines a central bore 44 into which the central portion 32 of the pole piece extends. A channel formed between the members 30, 38 supports an O-ring seal 45 which is to prevent leakage of fluid therebetween. A coil of wire 46 is wound about bobbin portion 40 and is encapsulated in a quantity of molded elastomeric material 48.

The opposite ends 46' and 46'' of the wire coil 46 are connected to a pair of elongated terminal members 50, 52. The lower portions of terminals 50, 52 are encapsulated in material 48 and the upper end portions extend through openings in portion 34 of the pole piece 30 where they are assessable for connection to leads (not shown) which selectively energize the coil.

At the outer edge of portion 42, an annular groove 54 is formed in bobbin member 38. The grove 54 supports an O-ring seal 56 to inhibit leakage between members 38, 12. When the assembly 28 is insertably assembled to housing 12, O-ring 56 engages bore wall 16 of housing 10 to inhibit fluid leakage therebetween.

Figure 2:
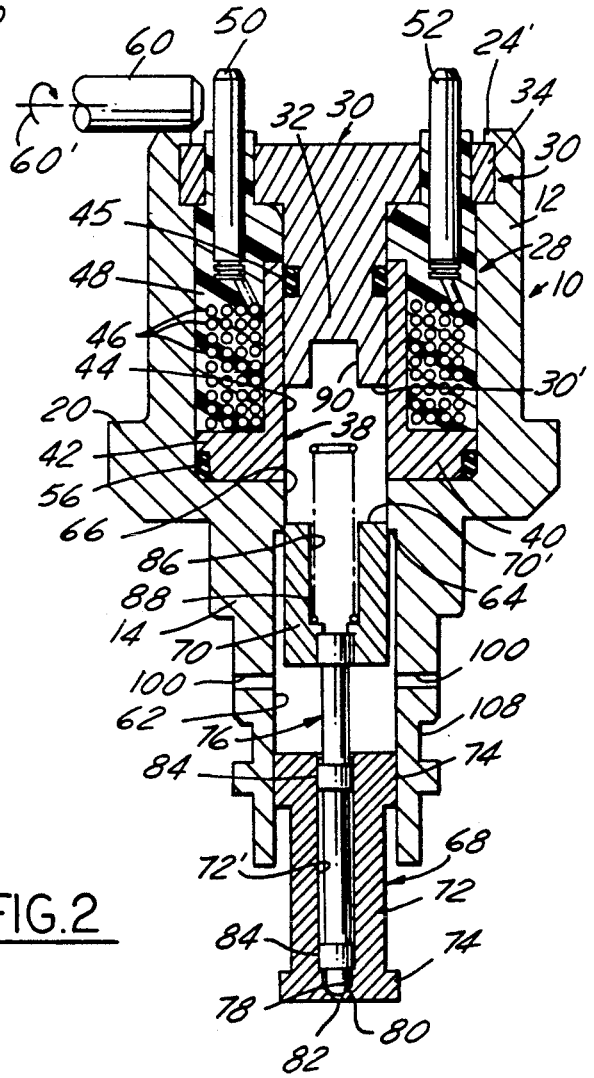

The first assembly step of the injector is illustrated in FIG. 1. This first step starts with insertion of the assembly 28 into the bore 16 in the downward direction indicated by the arrow 58. As shown in FIG. 2, this first step is completed when surfaces 34' and 42' of the assembly 28 engages shoulders 26 and 18, respectfully.

FIG. 2 illustrates what may be regarded as the final portion of the first step which is the attachment of assembly 28 to housing 10. Simultaneously, the assembly 28 is axially fixed relative to housing 12. This is accomplished by rolling or turning edge portion 24 radially inward over upper surface 34'' of the assembly 28. The resultant overlying edge portion 24' shown in FIG. 2 secures the assembly 28 to the housing. The edge 24 can be rolled over or turned inwardly by a tool 60 which is rotated as indicated by arrow 60' and also moves around the top surface of the housing 10. Alternately, a stationary tool could be utilized and the housing 10 rotated under it.

Referring to FIGS. 1 and 2, it can be seen that the lower portion 14 of the housing 10 has a bore 62 extending therein. Bore 62 terminates at an internal shoulder 64 which is formed adjacent a smaller bore 66. Bore 66 connects interiors 12' and 14' of the upper and lower portions 12, 14. In FIG. 2, a combined valve guide, seat, armature and valve member which defines a subassembly 68 is illustrated. The subassembly 68 is shown partly inserted into bores 62, 66.

Specifically, subassembly 68 includes cylindrical and tubular armature member 70 which has an external dimension sized to closely fit in bore 66 so that reciprocal movement is permitted. Below member 70, is an elongated, tubular valve guide and valve seat forming member 72. Member 72 has a cylindrical outer surface 74 sized to closely fit into bore 62 so that fuel leakage therebetween is inhibited. Member 72 supports an elongated valve member 76 which extends through an interior bore 72' of member 72. The lower end of the guide member 72 forms a conically shaped valve seat configuration 78 adapted to cooperate with the lower end surface 80 of the valve member 76. This lower end surface 80 has a semi-spherical configuration which defines a valve surface. The valve seat 78 encircles an outlet opening 82 in the end of the member 72. The opening 82 is for directing a spray of fuel into an associated combustion chamber (see FIG. 5). Surfaces 84 of valve 76 are sized to fie closely in internal bore 72' so that valve 76 may reciprocate relative to the guide member 72.

The armature 70 is attached to the upper end of elongated valve member 76 by a press fit or other appropriate attachment means. Armature 70 has an interior cavity 86 which receives the lower end portion of a coil type spring 88. The upper end portion of the coil spring 88 is received into cavity 90 in the pole piece 28.

Figure 3:
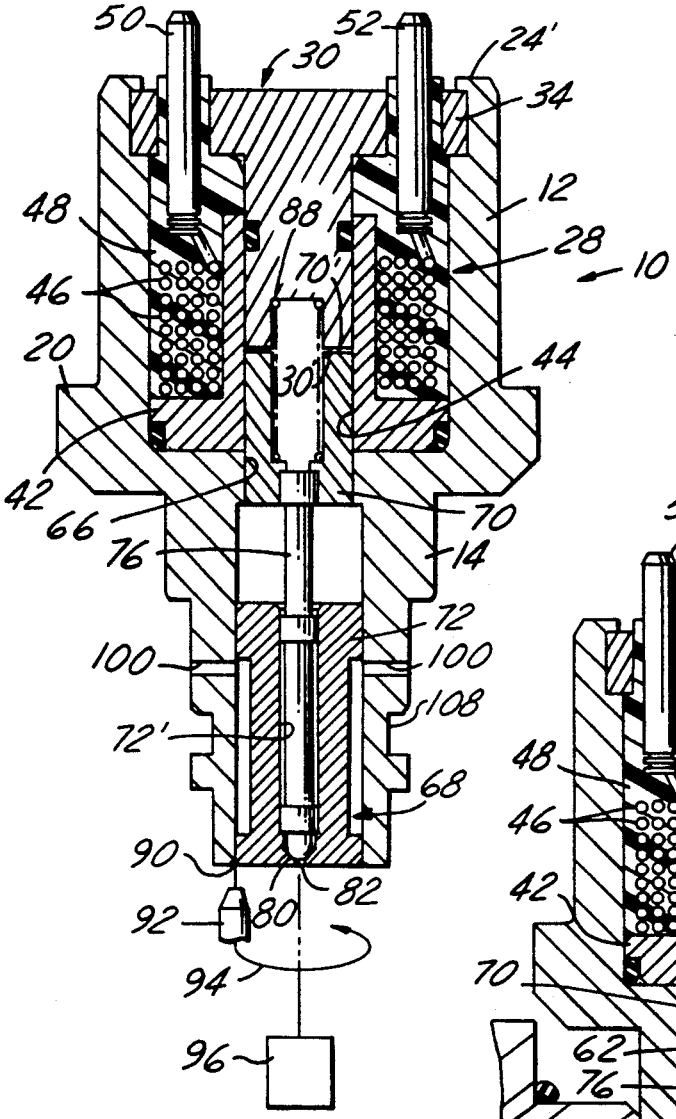

FIG. 2 illustrates the beginning stage of the next major assembly step for the fuel injector, namely, the upward initiation of the insertion of subassembly 68 into the lower end portion 14 of housing 10. FIG. 3 illustrates completion of this insertion step. Note that spring 88 is compressed as insertion takes place and consequently a downward closing force is placed on the armature and attached valve member 76.

When the insertion of subassembly 68 into the housing is finished, the fuel injector is calibrated. The subassembly 68 is fully inserted into the bores 44, 62, 66 until contact is made between the armature's upper surface 70' with the pole piece's lower surface 30'. The guide member 72 of subassembly 68 is then axially withdrawn downwardly a predetermined axial distance to form the desired gap between surfaces 30' and 70' as shown in FIG. 3. The valve guide member 72 is then fixed in the axial direction and sealed to the housing 10 by a weldment 90. A weld head 92 applies the weldment 90 by movement in circle 94. Alternately, the weld head 92 could be held stationary and the fuel injector rotated relative to it by means 96 attached to the housing 10.

Figure 4:
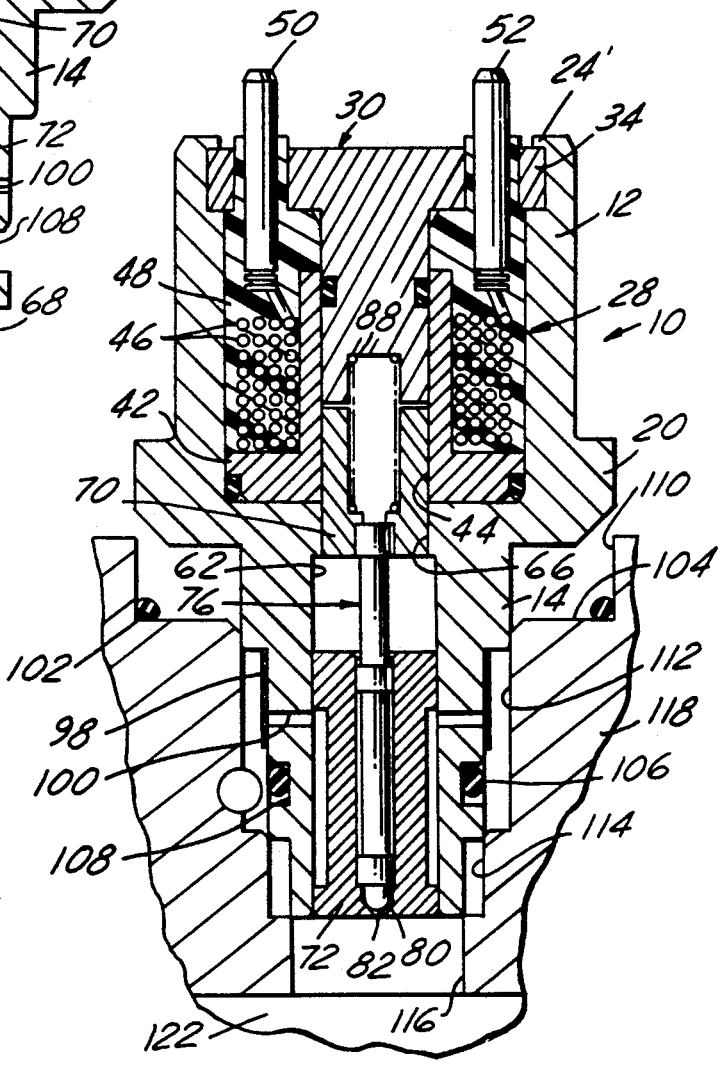
Figure 5:
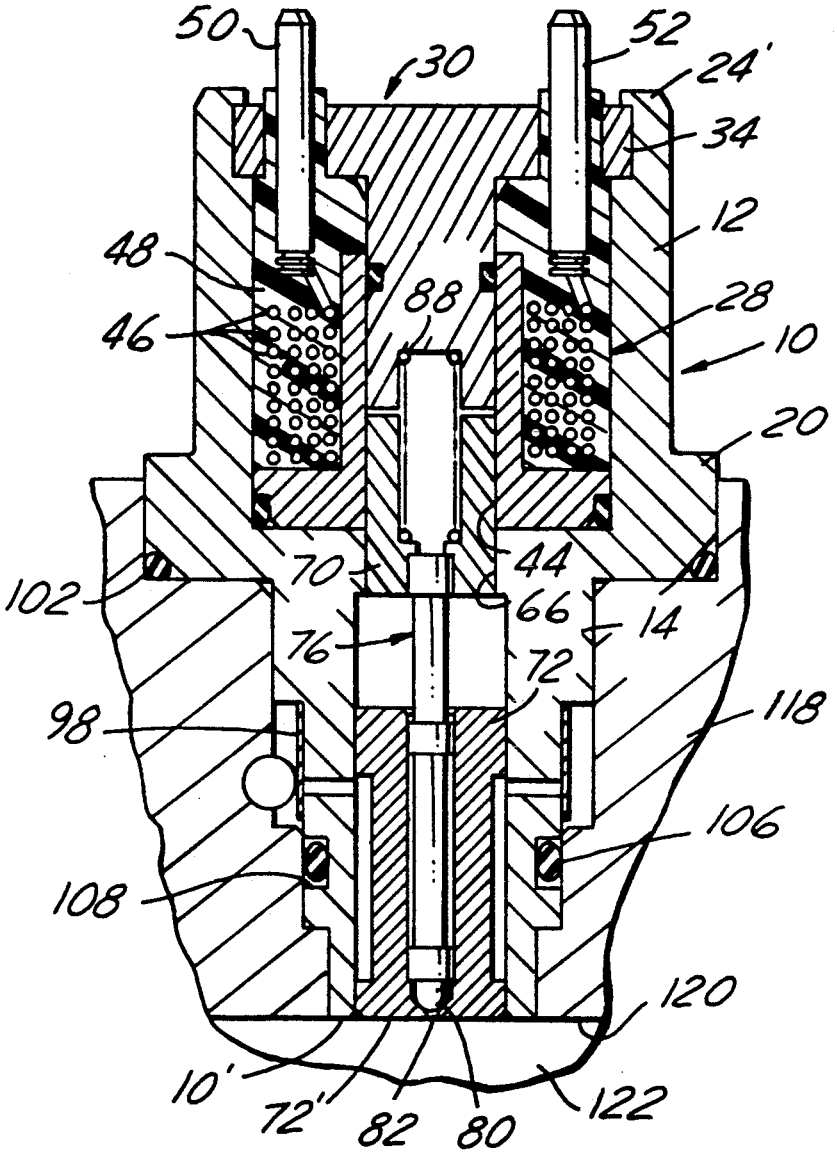

The fully assembled and calibrated fuel injector is now ready for use with an internal combustion engine as shown in FIGS. 4 and 5. Before attachment of the injector to the engine, a screen or filter 98 is located about lower portion 14 and over fluid inlet 100. An O-ring seal 102 is positioned against a shoulder 104 and another O-ring seal 106 is positioned in a channel 108 in housing portion 14. Next, the housing 10 is moved downward and lower portion 14 is inserted into step bores 110, 112, 114, and 116 of an engine cylinder head 118. FIG. 5 illustrates a complete insertion into bores 110, 112, 114 and 116. The end surfaces 10' and 72' of housing 10 and valve guide 72 are coplanar with the interior surface 120 of the combustion chamber 122. A member (not shown) axially secures the injector within bores 110, 112, 114 and 116.

Although only one embodiment of the fuel injector and a specific assembly and calibration method or procedure has been illustrated and described in detail, it should be understood that modifications are contemplated which fall within the scope of the invention as defined by the following claims.

What is claimed is as follows:

1. A method of assembling and calibrating a fuel injector which includes a tubular housing with opposite open ends, comprising: inserting an electromagnetic actuator subassembly into one end opening of the housing; securing the electromagnetic actuator subassembly in the housing to prevent any axial movement; inserting a valve subassembly including a movable valve, a valve support and seat, and an armature into the opposite end opening of the housing; establishing a desired maximum valve opening by gapping the armature a predetermined space from a stationary portion of the injector while the valve is in its closed seated operational position; permanently attaching the valve support and seat to the housing thus establishing the desired opening calibration of the fuel injector.

2. The method of assembling and calibrating a fuel injector as set forth in claim 1 in which the one opened end of the housing is defined first by a large bore and then a lesser bore to define an interior shoulder portion therebetween; and inserting the actuator subassembly into the bore until it seats against the shoulder.

3. The method of assembling and calibrating a fuel injector as set forth in claim 2 in which an edge portion of the housing is distorted over the actuator subassembly to attach the subassembly in the housing.

4. The method of assembling and calibrating a fuel injector as set forth in claim 1 and welding the valve support and seat to the housing to attach the valve subassembly in the established axial position for a desired maximum opening of the valve.

5. A method of assembling and calibrating a fuel injector which includes a tubular housing with opposite open ends, one opened end of the housing having first by a large bore and then a lesser bore to define an interior shoulder portion therebetween; inserting an electromagnetic actuator subassembly into the bore until it seats against the shoulder; securing the electromagnetic actuator subassembly in the housing to prevent any axial movement by distorting an edge portion of the housing over an exterior portion of the actuator subassembly; inserting a valve subassembly including a movable valve, a valve support and seat, and an armature into the opposite end opening of the housing; establishing a desired maximum valve opening by gapping the armature a predetermined space from a stationary portion of the injector while the valve is in its closed seated operational position; permanently attaching the valve support and seat to the housing by welding the valve support and seat to the housing thereby calibrating the desired opening of the fuel injector.

* * * * *